United States Patent [19]

Miyazako et al.

[11] 4,126,467

[45] Nov. 21, 1978

[54] SILVER HALIDE PHOTOGRAPHIC MATERIALS HAVING IMPROVED ANTI-STATIC PROPERTIES

[75] Inventors: Takushi Miyazako; Itsuki Toriya; Masuhiko Hirose, all of Minami-ashigara, Japan

[73] Assignee: Fuji Photo Film Co., Ltd., Minami-ashigara, Japan

[21] Appl. No.: 871,886

[22] Filed: Jan. 24, 1978

[30] Foreign Application Priority Data

Jan. 24, 1977 [JP] Japan ..... 52-7032
Jul. 12, 1977 [JP] Japan ..... 52-83231

[51] Int. Cl.[2] ..... G03C 1/78

[52] U.S. Cl. ..... 96/87 A; 96/67; 96/114.2

[58] Field of Search ..... 96/87 A, 67, 114.2

[56] References Cited

U.S. PATENT DOCUMENTS

| | | | |
|---|---|---|---|
| 2,322,037 | 6/1943 | Lindquist | 96/87 A |
| 3,794,495 | 2/1974 | Ishihara et al. | 96/87 A |
| 3,988,158 | 10/1976 | Muramatsu et al. | 96/87 A |
| 4,050,940 | 9/1977 | Habu et al. | 96/114.2 |
| 4,069,053 | 1/1978 | Mayama et al. | 96/114.2 |

*Primary Examiner*—J. Travis Brown
*Attorney, Agent, or Firm*—Sughrue, Rothwell, Mion, Zinn and Macpeak

[57] ABSTRACT

A silver halide photographic material having improved anti-static properties comprising a support having thereon at least one silver halide emulsion layer and which contains in an outermost layer of the photographic material, in a layer contiguous to a subbing layer for a silver halide emulsion layer in the photographic material, and/or in a layer contiguous to the outermost layer provided on the opposite side of the support to that on which the silver halide emulsion layer is present in the photographic material a compound having a molecular weight of about 1,000 to about 50,000 and a recurring unit represented by the following general formula (I)

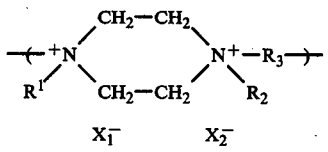

(I)

$R_1$ and $R_2$, which may be the same or different, each represents an alkyl group, a cycloalkyl group, an aralkyl group, an aryl group or an alkenyl group, or $R_1$ and $R_2$ can combine and form an alkylene chain; $R_3$ represents an alkylene group or an aralkylene group having 10 or less carbon atoms; and $X_1^-$ and $X_2^-$ each represents an anion; and a method for preventing the generation of static charges in a photographic material.

10 Claims, No Drawings

SILVER HALIDE PHOTOGRAPHIC MATERIALS HAVING IMPROVED ANTI-STATIC PROPERTIES

BACKGROUND OF THE INVENTION

1. Field of the Invention

This invention relates to silver halide photographic materials having improved anti-static properties. More particularly the present invention relates to silver halide photographic materials comprising a support with at least one light-sensitive silver halide emulsion layer thereon and at least one anti-static layer thereon and to a method for prevention of the generation of static charges in a photographic material.

2. Description of the Prior Art

Electrostatic charges tend to accumulate on a photographic material during the production and the use thereof, thus causing a number of disadvantages. This generation of electrostatic charges takes place during the manufacturing procedures when the photographic material is brought into contact with rollers in the production line, or when the photographic material is wound up into or unwound from a roll whereby friction and separation occur between the emulsion-coated side and the opposite side to the emulsion-coated side of the photographic material. After the photographic product is delivered to the consumer, on the other hand, electrostatic charges tend to be generated when the photographic product is exposed to very high humidity conditions sufficient to cause adhesion between the emulsion-coated surface and the opposite surface thereof and both surfaces are separated later, or when the photographic product is run in a movie camera or processed in an automatic processor such as, for example, an X-ray film processor. When the accumulated electrostatic charges discharge, the photographic product is undesirably exposed to give rise to irregular static marks comprising spotty, arborescent or feather-like patterns and the like after development. Since these static marks are undetectable until after processing and deteriorate the commercial value of the photographic product to a great extent, the generation of static marks has been a very serious difficulty encountered in the photographic industry and the problem is quite difficult to solve. Further, the accumulated charge tends to attract dust onto the surface of the photographic material, which becomes a cause of secondary difficulties such as coating non-uniformity. It should further be noted that the probability for static marks to occur is sure to increase as the processing speed is increased and as the photographic speed of the emulsion is increased, since most of the supports for photographic products are hydrophobic and sufficiently electrically insulating that electrostatic charges accumulate thereon.

Conventionally, a variety of materials have been used to prevent the generation of static charges in photographic materials. Such anti-static agents are, in general, ionically conductive or have a hygroscopic nature, which property imparts to the photographic product an electrically conductive nature, enabling the electrostatic charge to dissipate easily and thus avoiding a drastic discharge of the accumulated charge. These agents can be used individually or in combination. In order to render the support of a photographic material anti-static, the anti-static agents can be directly incorporated into the high-molecular weight material for the support, or can be coated on the support surface. In the latter case, a coating comprising an anti-static agent alone, or a coating comprising a mixture of an anti-static agent and a polymeric material such as gelatin, poly(vinyl alcohol), cellulose acetate, poly(vinyl butyral), poly(vinyl formal), etc. can be applied to the support. Additionally, the anti-static agent can be incorporated into various layers provided on the support such as the light-sensitive emulsion layer, and other non-light-sensitive, auxiliary layers (e.g., a backing layer, an anti-halation layer, intermediate layers, a protective layer, etc.) An anti-static agent may be applied on the surface of the processed photographic product for the purpose of preventing dust adhesion during subsequent handling thereof. Most of the anti-static agents well known in the art have not been sufficiently effective for photographic products coated with a highly sensitive photographic emulsion, particularly under low humidity conditions e.g., a relative humidity of 30%, undergo a decline in the anti-static effect provided with the passage of time, have a tendency to cause adhesion difficulties under humid conditions, or have a deleterious effect on photographic performances. Since the majority of known anti-static agents were difficult to apply to photographic products as a result of these reasons, various attempts have been made to use recently synthesized anti-static agents in photographic materials. For example, Japanese Patent Application (OPI) No. 91,165/1973 (corresponding to British Pat. No. 1,388,083) and Japanese Patent Application (OPI) No. 121,523/1974 (corresponding to U.S. Pat. No. 3,876,430) describe silver halide photographic products in which so-called ionene type polymers having dissociable groups in the polymer backbone are used. However, such materials do not exhibit an acceptable level of anti-static capability.

SUMMARY OF THE INVENTION

One object of the present invention is to provide photographic materials having improved anti-static properties and having, firstly, a remarkably low surface resistance; secondly, superior physical properties as a film; and thirdly a complete lack of any tendency toward blocking.

Another object of the present invention is to provide a method of preventing the generation of static charges in a photographic material by the use of an anti-static coating which has the characteristics described above.

The object of the present invention is achieved in one embodiment by a silver halide photographic material comprising a support having thereon at least one silver halide emulsion layer and which photographic material contains in a layer contiguous to a subbing layer for the silver halide emulsion layer, in a layer contiguous to the outermost coating layer provided on the side of the support opposite that on which the silver halide emulsion layer is coated and/or in an outermost layer of the photographic material a compound having a molecular weight of about 1,000 to about 50,000 and a recurring unit represented by the general formula (I)

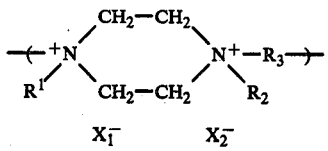

(I)

wherein $R_1$ and $R_2$, which may be the same or different, each represents an alkyl group, a cycloalkyl group, an aralkyl group, an aryl group or an alkenyl group, and $R_1$ and $R_2$ can combine to form an alkylene group; $R_3$ represents an alkylene group or an aralkylene group, each having up to ten carbon atoms; and $X_1^-$ and $X_2^-$ each represents an anion.

In another embodiment, the invention provides a method of preventing the generation of static charges in a silver halide photographic material comprising a support having thereon at least one silver halide emulsion layer which comprises incorporating into an outermost layer of the photographic material, into a layer contiguous to a subbing layer for a silver halide emulsion layer in the photographic material and/or into a layer contiguous to the outermost layer provided on the opposite side of the support to that on which the silver halide emulsion layer is present on the photographic material a compound having a molecular weight of about 1,000 to about 50,000 and having therein a recurring unit represented by the general formula (I), as described above.

Hereinafter, the compounds having a molecular weight of about 1,000 to about 50,000 and containing therein a repeating unit represented by the general formula (I), for brevity, will be called "compounds represented by the general formula (I)".

DETAILED DESCRIPTION OF THE INVENTION

In the general formula (I) above, $R_1$ and $R_2$, which may be the same or different, each represents a straight chained or cyclic alkyl group (which may be unsubstituted or substituted with one or more substituents, for example, a cycloalkyl group, a hydroxy group, an alkoxycarbonyl group, a carbamoyl group, etc.), an aralkyl group (e.g., a benzyl group, a phenethyl group, etc.), an aryl group (e.g., a phenyl group, etc.), or an alkenyl group (e.g., an allyl group, a propenyl group, a butenyl group, etc.) and which preferably has 1 to 10 total carbon atoms. $R_1$ and $R_2$ may also combine together to form an alkylene group (e.g., an ethylene group, etc.). Suitable specific examples of straight chained alkyl groups having 1 to 10 total carbon atoms for $R_1$ and $R_2$ include a methyl group, an ethyl group, a propyl group, a butyl group, a hexyl group, an octyl group, a carboxyethyl group, an alkoxycarbonylethyl group (e.g., a methoxycarbonylethyl group, an ethoxycarbonylethyl group, a propoxycarbonylethyl group, a butoxycarbonylethyl group, etc.), a benzyl group, a phenethyl group, a cyanoethyl group, a hydroxyethyl group, a hydroxypropyl group, a carbamoylethyl group, a cyclohexylmethyl group and suitable examples of alkenyl groups for $R_1$ and $R_2$ include a propenyl group, a butenyl group, etc.

$R_3$ represents an alkylene group, an alkenylene group or an aralkylene group, each having up to 10 carbon atoms. Specific examples of alkylene groups, alkenylene groups and aralkylene groups having up to 10 carbon atoms for $R_3$ include an ethylene group, a trimethylene group, a tetramethylene group, a hexamethylene group, an octamethylene group, a butenylene group (e.g., a $-CH_2CH{=}CHCH_2-$ group), a xylylene group, etc.

$X_1$ and $X_2$ each represents an anion, preferably a halogen ion, an acetate ion, a perchlorate ion, $R_4O-SO_2-O^{\ominus}$, $R_4-SO_2-O^{\ominus}$ or $(HO)_2PO-O^{\ominus}$ wherein $R_4$ represents a methyl group, an ethyl group, a phenyl group or a phenyl group substituted with one or more methyl groups. More preferably the anion is a halogen ion such as chloride or bromide. The degree of polymerization of the compound containing the recurring unit represented by the general formula (I) is such that the molecular weight ranges from about 1,000 to about 50,000.

The compounds represented by the general formula (I) can be synthesized by reaction of a diamine represented by the following general formula (II)

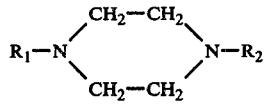

(II)

wherein $R_1$ and $R_2$ are defined as in the general formula (I); with a compound represented by the general formula (III)

$$X_1 - R_3 - X_2$$

wherein $R_3$ is as defined in general formula (I), and $X_1$ and $X_2$ each represents a chlorine atom, a bromine atom, an iodine atom, an acetate group, a perchlorate group, $R_4-OSO_2O-$, $R_4-SO_2-O$, or $(HO)_2-PO-O-$ wherein $R_4$ represents a methyl group, an ethyl group, a phenyl group or a phenyl group substituted with one or more methyl groups. $X_1$ and $X_2$ can be the same or different, and most preferably are chlorine or bromine.

Suitable examples of the compounds represented by the general formula (II) include 1,4-dimethylpiperazine, triethylene diamine, 1,4-bis(hydroxyethyl)piperazine, 1,4-diethylpiperazine, 1,4-dibenzylpiperazine, 1,4-bis(cyclohexylmethyl)piperazine, 1,4-bis(cyanoethyl)piperazine, 1,4-bis(2-carbamoylethyl)piperazine, 1,4-bis(carboxyethyl)piperazine, 1,4-bis(carbomethoxyethyl)piperazine, 1,4-diallylpiperazine, 1,4-dicyclohexylpiperazine, 1,4-bis(butoxycarbonylethyl)-piperazine, 1,4-dioctylpiperazine, etc. Particularly suitable compounds represented by the general formula (II) are 1,4-dimethylpiperazine and triethylene diamine with triethylene diamine being most preferred.

Suitable compounds represented by the general formula (III) include o-xylylene dichloride, m-xylylene dichloride, p-xylylene dichloride, o-xylylene dibromide, m-xylylene dibromide, p-xylylene dibromide, 1,2-dichloroethane 1,2-dibromoethane, 1,4-dichlorobutane, 1,4-dibromobutane, 1,4-dichlorobutene, 1,6-dichlorohexane, 1,6-dibromohexane, 1,8-dichloroctane, etc. Particularly suitable compounds represented by the general formula (III) are p-xylylene dichloride, p-xylylene dibromide, 1,2-dichloroethane, and 1,2-dibromoethane with p-xylylene dichloride being most preferred.

The compound represented by general formula (I), and characterized as the anti-static agent used in present invention, can be prepared by adding a compound represented by the general formula (II) and one represented by the general formula (III) in equi-molar amounts into a suitable solvent system comprising, for example, water, dimethylformamide, dimethyl sulfoxide, methanol, ethanol, acetonitrile, dioxane, and by reacting them at a temperature between about 20° and about 150° C., more preferably between 30° and 70° C., for a period of from about 6 to about 100 hours.

A suitable range for the molecular weight of the anti-static agent used in the present invention ranges between about 1,000 and about 50,000, and preferably between 2,000 and 10,000.

The viscosity ($\eta_{sp}/c$) of the compound represented by the general formula (I) as measured at a concentration of 0.1% by weight in a 1% aqueous NaCl solution at 30° C. should range from about 0.02 to 0.2, and more preferably from 0.05 to 0.15.

Representative examples of the synthesis of compounds of the general formula (I) are set forth below. Unless otherwise indicated herein, all parts, percents ratios and the like are by weight.

SYNTHESIS EXAMPLE 1

35.45 g (0.2 mole) of p-xylylene dichloride, 23.1 g (0.2 mole) of N,N'-dimethylpiperazine and 100 ml of formamide were charged in a reaction vessel, and agitated at 40° C. for 15 hours. After reprecipitation in ethyl acetate, the reaction product was dried. The yield was 52.7 g (90.0%).

The viscosity ($\eta_{sp}/c$) of the resulting polymer was 0.12 at a 0.1% concentration in a 1% aqueous NaCl solution at 30° C. The resultant product of this reaction is designated as Compound (1) and is shown in Table 1 below.

SYNTHESIS EXAMPLES 2-10

Using similar procedures, Compounds (2) to (10) were prepared. Their chemical structures and viscosities are also shown in Table 1 below.

Table 1

| Compound No. | Structure | Viscosity ($\eta_{sp}/c$) |
|---|---|---|
| (1) | 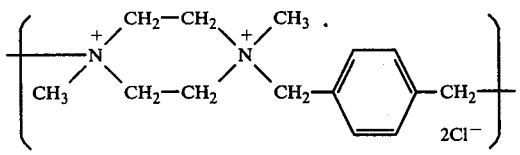 | 0.12 |
| (2) | 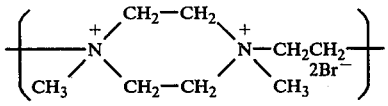 | 0.08 |
| (3) | 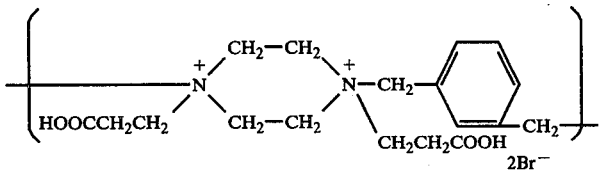 | 0.07 |
| (4) | 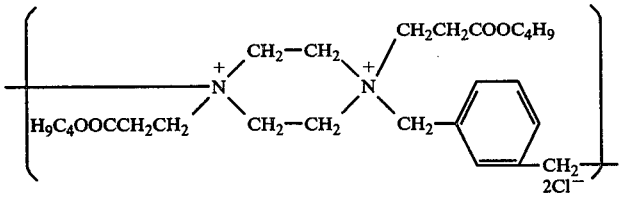 | 0.05 |
| (5) | 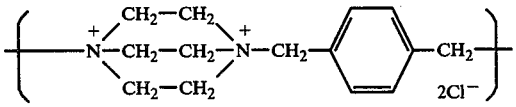 | 0.12 |
| (6) | 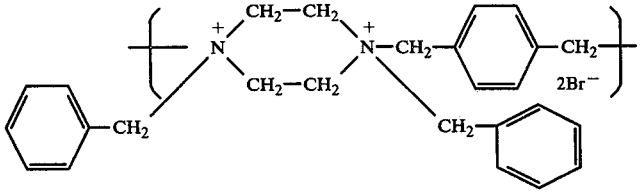 | 0.05 |
| (7) | 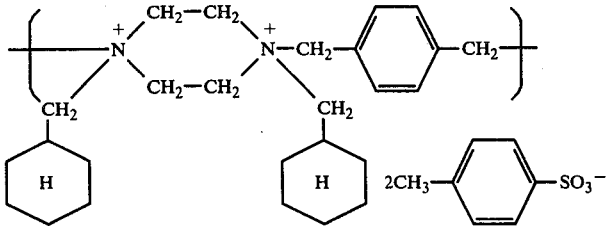 | 0.10 |

Table 1-continued

| Compound No. | Structure | Viscosity ($\eta_{sp}/c$) |
|---|---|---|
| (8) | 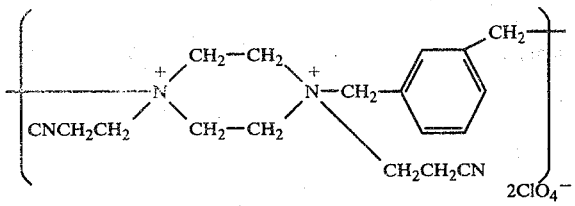 | 0.11 |
| (9) | 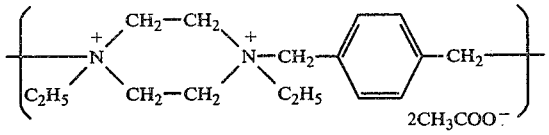 | 0.10 |
| (10) | 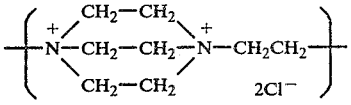 | 0.04 |

For the purpose of comparison, two compounds [designated as Compounds (A) and (B)] disclosed in Japanese Patent Application (OPI) No. 91,165/1973 and 121,523/1974, were prepared as shown in Table 2 below.

Table 2

| Compound No. | Structure | Viscosity ($\eta_{sp}/c$) |
|---|---|---|
| (A) | 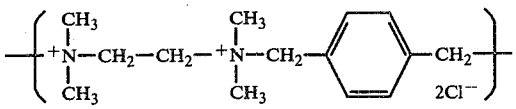 | 0.12 |
| (B) | 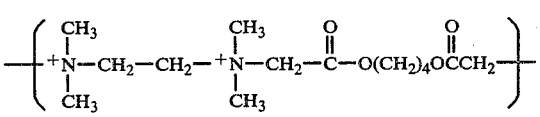 | 0.10 |

The amount of the compound used in the present invention represented by the general formula (I) will vary depending on the kind and the configuration of the photographic material in which it is used and further on the coating method employed. However, the compound used in the present invention is desirably present in an amount of from about 0.01 to about 1.0 g and more preferably from 0.03 to 0.4 g per $m^2$ of the photographic material.

The compound represented by general formula (I) used in the present invention can be applied to the surface coating of the photographic material by first dissolving the compound in a suitable solvent system comprising water, an organic solvent (e.g., methanol, ethanol, acetone, methyl ethyl ketone, ethyl acetate, acetonitrile, dioxane, dimethylformamide, formamide, dimethyl sulfoxide, methyl Cellosolve, ethyl Cellosolve, etc.) or mixtures thereof, and then treating a photographic emulsion layer, a light-insensitive auxiliary layer (e.g., a backing layer, an anti-halation layer, an intermediate layer, a protective layer, etc.) or the surface of the support with the resulting solution by spraying, coating or immersion. Finally, the processed layer is dried.

Alternatively, an anti-static coating comprising a compound represented by the general formula (I) and a binder such as gelatin, poly(vinyl alcohol), cellulose acetate, cellulose acetate phthalate, poly(vinyl formal), poly(vinyl butyral), etc., can be provided as the outermost layer of the photographic material.

A particularly advantageous result can be obtained when a compound represented by the general formula (I) used in the present invention is incorporated in a surface coating containing about 5 to about 1,000 mg/$m^2$, preferably 10 to 300 mg/$m^2$, of a fluorine-containing surfactant and about 30 to about 500 mg/$m^2$, preferably 50 to 200 mg/$m^2$, of a matting agent. More specifically, fluorine-containing surfactants effectively prevent a generation of static marks. Further, other additives such as a hardener, an antifriction agent, an halation preventing dye, etc. can be present in the surface coating.

Matting agents which are effective in the present invention include silver halide, barium strontium sulfate, poly(methyl methacrylate), a methyl methacrylate/methacrylic acid copolymer, colloidal silica, pulverized silica, etc.

Further, fluorine-containing surfactants which exhibit a synergistic effect with the compound represented by the general formula (I) are those set forth in British Pat. No. 1,330,356, U.S. Pat. No. 3,666,478 and 3,589,906, etc. Typical examples of these compounds include, potassium N-perfluorooctylsulfonyl-N-propylglycinate, 2-(N-perfluorooctylsulfonyl-N-ethylamino)ethylphosphate, N-[4-(perfluorononyloxy)-benzyl]-N,N-dimethylamino acetate, N-[4-(perfluorononyloxy)-benzyl]-N,N'-dimethyl-α-carboxylic acid betaine, N-[3-

(N',N',N'-trimethylammonio)propyl]perfluorooctylsulfonamide iodide, and N-(polyoxyethylenyl)-N-propylperfluorooctylsulfoamide, i.e., $[C_8F_{17}SO_2N(C_3H_7)(CH_2CH_2O)_nH]$ where $n$ is 3 to 12.

Surface coatings of silver halide photographic materials include the outermost back coating provided on the side of the support opposite to that on which the silver halide emulsion layer or layers are provided, and the outermost layer overlaying the photographic silver halide emulsion coating layer or layers (e.g., a protective coating, a top emulsion coating, etc.), etc.

The compound represented by the general formula (I) can further be incorporated in a layer contiguous to the subbing layer for the silver halide emulsion layer and/or in a layer contiguous to the outermost layer provided on the side of the support opposite that on which the silver halide emulsion layer is coated. A layer contiguous to the subbing layer implies either a light-insensitive layer interposed between the support and the subbing layer or a light-insensitive layer provided directly on the subbing layer. By incorporating one of the compounds of the general formula (I) used in the present invention in such a layer electrostatic difficulties during the manufacture of the photographic material can be effectively mitigated. The anti-static agent of the present invention is preferably present in a layer just above the subbing layer in comparison with its use in the layer just below the subbing layer.

A layer contiguous to the outermost layer at the back side of the support implies a layer directly below the so-called back coating which comprises a binder such as a cellulose ester (e.g., cellulose diacetate, cellulose triacetate, nitrocellulose, etc., and, if required, a matting agent, an antifriction agent, a dye, etc.). When the anti-static compound used in the present invention is present in such a layer, electrostatic difficulties can be removed during the manufacture and particularly the use of the photographic material.

The compound of the present invention can be applied to one of the above described layers of the photographic material by first dissolving it in a suitable solvent such as water, an organic solvent (e.g., methanol, ethanol, acetone, methyl ethyl ketone, ethyl acetate, acetonitrile, dioxane, dimethylformamide, formamide, dimethyl sulfoxide, methyl Cellosolve, ethyl Cellosolve, etc.) or a mixture thereof, and coating the resultant solution by spraying, spreading or dipping, as described above for incorporation of the anti-static compound in an outermost layer of the photographic material.

A suitable film-forming binder can be used with the anti-static agent to form an anti-static coating. Suitable materials include gelatin, poly(vinyl alcohol), cellulose acetate, cellulose acetate phthalate, poly(vinyl formal), poly(vinyl butyral), etc.

Suitable materials which can be used as supports in the present invention include, for example, polymer films comprising polyolefins such as polyethylene, cellulose derivatives such as cellulose triacetate, polyesters such as poly(ethylene terephthalate), various papers such as baryta coated paper, synthetic paper, etc., and various laminated sheets comprising paper both surfaces of which are covered with a synthetic resin film such as those cited above.

An anti-halation coating can be provided on the support for the present invention. Such an anti-halation coating may contain carbon black and/or a number of dyes including, for example, oxonol dyes, azo dyes, arylidene dyes, styryl dyes, anthraquinone dyes, merocyanine dyes, tri- or diarylmethane dyes, etc., and a binder for such dyes. Suitable binders include cellulose acetate (including cellulose mono-acetate and cellulose di-acetate), poly(vinyl alcohol), poly(vinyl butyral), poly(vinyl acetal), poly(vinyl formal), a poly(alkyl methacrylate), a poly(alkyl acrylate), polystyrene, a styrene/maleic anhydride copolymer, poly(vinyl acetate), a vinyl acetate/maleic anhydride copolymer, a methyl vinyl ether/maleic anhydride copolymer, poly(vinylidene chloride), and derivatives thereof.

Silver halide photographic materials to which the present invention is applicable include ordinary monochromatic photographic films (e.g., camera speed monochromatic films, X-ray films, lithographic films, etc.), ordinary color films having a multi-layer structure (e.g., color reversal films, color negative films, color positive films, etc.), and still other types of silver halide photographic materials. It should be noted that the present invention is particularly effective for silver halide photographic materials which are subjected to a rapid processing at an elevated temperature e.g., 27° C. or higher and also for those having a relatively high photographic speed.

Specific examples of the present invention are illustrated below but should not be construed as limiting the scope of the present invention.

EXAMPLE 1

Sample Preparation 8 g of each of Compounds (1) to (10) used in the present invention and Compound (A) and (B) as conventionally known materials was dissolved in 10 ml water, and further diluted with 650 ml methanol and 350 ml acetone. This solution was coated on a cellulose triacetate film at a coating rate of 50 mg/m$^2$ and the film was dried. Over this coating, a coating mixture comprising 0.3 g of colloidal silica with a particle diameter of from 0.05 to 3 microns dispersed in a solvent mixture of 300 ml of acetone and 600 ml of methanol was applied. On the other side of the thus-treated film support was coated an indirect X-ray photographic silver halide emulsion comprising 9% by weight of gelatin and 9% by weight of silver iodobromide containing 5 mol % iodide. Using these procedures, Samples No. 1 to No. 13 were prepared, each of which contains one of the anti-static agents designated as Compounds (A) and (B), (1), to (10), while Sample No. 13 was a control.

EVALUATION OF STATIC PREVENTION PROPERTIES

Static prevention properties were evaluated by the value of the surface resistance and the tendency toward generation of static marks. (1) The surface resistivity was measured using an insulation meter ("TR-8651" available from Takeda Riken Co.) using a sample test piece on which a pair of brass electrodes of a length of 10 cm were placed with a spacing of 0.14 cm between the electrodes. The portion of the electrode which contacted the surface of the sample test pieces was made of stainless steel, and the value of surface resistance after 1 minute was recorded. (2) Testing for generation of static marks was carried out by placing a sample of the unexposed photographic material on a sheet of rubber with the anti-static layer coated surface of the photographic material down, pressing the sample to the rubber sheet using a rubber roller from above, and then peeling off the piece from the rubber sheet whereby static marks were generated on the photographic material.

The ambient conditions for each measurement were 25° C. and 30% R.H. for both tests. Prior to measurement, the sample test pieces were conditioned overnight in an atmosphere at 25° C. and 30% RH for measurement.

In order to evaluate the degree of generation of static marks, each sample was processed with a photographic developer having the following composition at 20° C. for 5 minutes.

| Developer Composition | |
|---|---|
| N-methyl-p-aminophenol Sulfate | 4 g |
| Sodium Sulfite (anhydrous) | 60 g |
| Hydroquinone | 10 g |
| Sodium Carbonate (monohydrate) | 53 g |
| Potassium Bromide | 25 g |
| Water to make | 1000 ml |

The tendency toward generation of static marks was evaluated using the following five grades.

A: No static marks generated at all.
B: Static marks generated to a slight extent.
C: Static marks generated to a considerable extent.
D: Static marks generated to a remarkable extent.
E: Static marks generated over the entire area of the sample.

The measured values of surface resistivity of the back surface of the sample and the evaluation of generation of static marks are shown in Table 3 below.

Table 3

| Sample No. | Anti-static Agent | Surface Resistance (ohms) | Static Mark Generation |
|---|---|---|---|
| 1 | Compound (1) | $8.7 \times 10^9$ | A |
| 2 | Compound (2) | $1.2 \times 10^{10}$ | A |
| 3 | Compound (3) | $5.3 \times 10^{11}$ | A - B |
| 4 | Compound (4) | $7.1 \times 10^{11}$ | A - B |
| 5 | Compound (5) | $2.6 \times 10^9$ | A |
| 6 | Compound (6) | $9.5 \times 10^{10}$ | A |
| 7 | Compound (7) | $2.4 \times 10^{10}$ | A |
| 8 | Compound (8) | $9.0 \times 10^9$ | A |
| 9 | Compound (9) | $2.0 \times 10^{10}$ | A |
| 10 | Compound (10) | $8.9 \times 10^{11}$ | A - B |
| 11 | Compound (A) | $6.5 \times 10^{12}$ | B |
| 12 | Compound (B) | $4.0 \times 10^{13}$ | B - C |
| 13 | None | $10^5$ or more | E |

By employing a compound of the general formula (I) as in the present invention, the surface resistance was reduced markedly, and generation of static marks was substantially prevented. On the contrary, it is evident that a considerable tendency toward static charge generation exists for films which contained the conventionally known anti-static agents or which did not contain an anti-static agent.

EXAMPLE 2

On one surface of a polyethylene terephthalate film was coated a 1.5% solution containing one of the following anti-static agents; Compounds (1), (5) and (8) of the present invention, and Compounds (A) and (B) for comparison. The coated film was dried. The coating amount was 150 mg/m$^2$. On the other surface of the film was coated an indirect X-ray emulsion comprising 9% gelatin and 9% silver iodobromide containing 5 mol % iodide. Sample Nos. 14 to 19 thus prepared are listed in Table 4 below together with the values of surface resistance for the back side and the tendency toward generation of static marks evaluated using a similar method to that set forth in Example 1.

Table 4

| Sample No. | Anti-static Agent | Surface Resistance (ohm) | Static Mark Generation |
|---|---|---|---|
| 14 | Compound (1) | $5.6 \times 10^{10}$ | A |
| 15 | Compound (5) | $3.0 \times 10^{10}$ | A |
| 16 | Compound (8) | $2.2 \times 10^{11}$ | A |
| 17 | Compound (A) | $8.6 \times 10^{12}$ | B - C |
| 18 | Compound (B) | $1.9 \times 10^{13}$ | C |
| 19 | None | $10^{15}$ or more | E |

As is evident from the results in Table 4, those sample films which contained an anti-static compound in accordance with the present invention exhibited a reduced tendency toward generation of static marks, while static marks were generated to a considerable on the sample films containing a compound for comparison.

EXAMPLE 3

Compound (1) as used in the present invention was dissolved in methanol containing 5% water to give a 0.5% solution. To 500 ml of the resulting solution was added 500 ml of a methanol solution containing 0.1% N-[4-(perfluorononyloxy)benzyl]-N,N-dimethyl-α-carboxylic acid betaine. This mixture was applied to one surface of a cellulose triacetate film in a coating amount of 50 mg/m$^2$. Further, a dispersion comprising 0.1 g of colloidal silica dispersed in 500 ml methanol was overcoated thereon. On the other side of the thus produced film was coated a multi-layer structure comprising color photographic silver halide emulsions disclosed in Example 2 of Japanese Patent Application No. 81,142/1976 (corresponding to U.S. Patent Application Ser. No. 813,738 filed July 7, 1977) as follows.

A red-sensitive emulsion layer was prepared as follows.

1-a: Preparation of silver halide emulsion for a unit emulsion layer having a low sensitivity:

A silver iodobromide emulsion containing 6% by mol of iodide (average grain size: 0.6 μ, which contained 100 g of silver halide and 70 g of gelatin per kg of the emulsion) was produced. To 1 kg of this emulsion, 180 cc of a 0.1% solution of anhydro-5,5'-dichloro-9-ethyl-3,3'-di-(3-sulfopropyl)thriacarbocyanine hydroxide pyridinium salt in methanol was added as a red-sensitive color sensitizing agent, and then 20 cc of an aqueous solution of 5% by weight of 5-methyl-7-hydroxy-2,3,4-triazaindolizine, 330 g of cyan coupler Emulsion (1) having the following composition and 20 g of the cyan coupler Emulsion (2) having the following composition were added thereto. Further, 50 cc of an aqueous solution of 2% by weight of 2-hydroxy-4,6-dichlorotriazine sodium salt was added as a gelatin hardening agent to produce an emulsion for the unit emulsion layer having a low sensitivity. This emulsion is designated (1A).

| Emulsion (1): | | |
|---|---|---|
| (1) | Gelatin (10 % by wt. aq. soln.) | 1,000 g |
| (2) | Sodium p-Dodecylbenzenesulfonate | 5 g |
| | Tricresylphosphate | 60 cc |
| | Cyan Coupler (C - 1) | 70 g |
| | Ethyl Acetate | 100 cc |

After the mixture (2) was dissolved at 55° C., it was added to (1) which was previously heated to 55° C. The resulting mixture was emulsified using a colloid mill.

Cyan Coupler (C - 1):

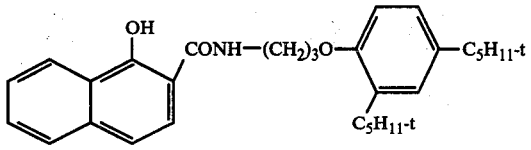

| Emulsion (2): | | |
|---|---|---|
| (1) | Gelatin (10 % by wt. aq. soln.) | 1,000 g |
| (2) | Sodium p-Dodecylbenzenesulfonate | 5 g |
| | Tricresyl Phosphate | 60 cc |
| | Cyan Coupler (C - 1) | 6 g |
| | DIR Cyan Coupler (D - 1) | 64 g |
| | Ethyl Acetate | 100 cc |

Emulsification was carried out using the same procedures as the case of Emulsion (1).

DIR Cyan Coupler (D - 1)

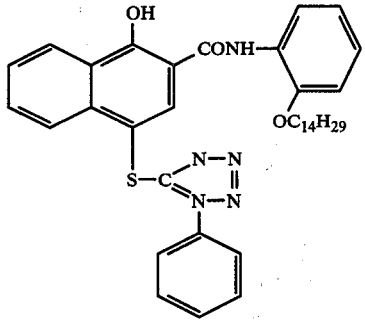

1 - b: Preparation of a silver halide emulsion for the unit emulsion layer having an intermediate sensitivity:

The procedures in 1 - a above were repeated with the following modifications:

| | | |
|---|---|---|
| Average Grain Size of Silver Halide | 0.9 μ | |
| Amount of Red-Sensitive Color Sensitizing Agent | 140 cc | |
| Amount of Emulsion Added | Emulsion (1): | 240 g |
| | Emulsion (2): | 10 g |

This emulsion is designated (2B).

1 - c: Preparation of a silver halide emulsion for the unit emulsion layer having a high sensitivity:

The procedures in 1 - a above were repeated with the following modifications.

| | |
|---|---|
| Average Grain Size of Silver Halide | 1.1 μ (but the amount of grains having a grain size of more than 1.0 μ was 50% by weight of the total grains and 8.9% of the total grains had a particle size of 2.0 μ or more) |
| Amount of Red-Sensitive Color Sensitizing Agent | 100 cc |
| Amount of Emulsion Added: | Emulsion (1): 150 g |

This emulsion is designated (1C).

A green-sensitive emulsion layer was prepared as follows.

2 - a: Preparation of a silver halide emulsion for the unit emulsion layer having a low sensitivity:

A silver iodobromide emulsion containing 6% by mol of iodide (average grain size: 0.6 μ, which contained 100 g of silver halide and 70 g of gelatin per kg of the emulsion) was prepared by a conventional method. To 1 kg of this emulsion, 200 cc of a 0.1% solution of 3,3'-di-(2-sulfoethyl)-9-ethylbenzoxacarbocyanine pyridinium salt in methanol was added as a green-sensitive color sensitizing agent, and then 20 cc of an aqueous solution of 5% by weight of 5-methyl-7-hydroxy-2,3,4-triazaindolizine was added thereto. Further, 380 g of magenta coupler Emulsion (3) having the following composition and 20 g of magenta coupler Emulsion (4) having the following composition were added thereto. In addition, 50 cc of an aqueous solution of 2% by weight of 2-hydroxy-4,6-dichlorotriazine sodium salt was added as a gelatin hardening agent to produce an emulsion for the unit emulsion layer having a low sensitivity. This emulsion is designated (2A).

| Emulsion (3): | | |
|---|---|---|
| (1) | Gelatin (10 % by wt. aq. soln.) | 1,000 g |
| (2) | Sodium p-Dodecylbenzenesulfonate | 5 g |
| | Tricresylphosphate | 65 cc |
| | Magenta Coupler (M - 1) | 63 g |
| | Ethyl Acetate | 110 cc |

After the mixture (2) above was dissolved at 55° C., it was added to (1) which was previously heated to 55° C. The resulting mixture was emulsified using a colloid mill.

Magenta Coupler (M - 1):
1-(2,4,6-Trichlorophenyl)-3-[3-(2,4-di-t-pentylphenoxyacetamido)benzamido]-5-pyrazolone

| Emulsion (4): | | |
|---|---|---|
| (1) | Gelatin (10 % by wt. aq. soln.) | 1,000 g |
| (2) | Sodium p-Dodecylbenzenesulfonate | 5 g |
| | Tricresylphosphate | 65 cc |
| | Magenta Coupler (M - 1) | 6 g |
| | DIR Magenta Coupler (D - 2) | 60 g |
| | Ethyl Acetate | 110 cc |

Emulsification was carried out using the same procedure as the case of Emulsion (3).

DIR Magenta Coupler (D - 2):
1-{4-[α-(2,4-Di-t-pentylphenoxy)butyramido]phenyl}-3-(1-pyrrolidinyl)-4-(1-phenyltetrazolyl-5-thio)-5-pyrazolone 2 - b: Preparation of a silver halide emulsion for the unit emulsion layer having an intermediate sensitivity:

285 g of Emulsion (3) and 15 g of Emulsion (4) were added as in the case of (2A) above and is designated (2B).

2 - c: Preparation of a silver halide emulsion for the unit emulsion layer having a high sensitivity:

200 g of Emulsion (3) was added as in the case of (2A) above and is designated (2C).

A blue-sensitive emulsion layer was prepared as follows.

3 - a: Preparation of a silver halide emulsion for the unit emulsion layer having a low sensitivity:

A silver iodobromide emulsion containing 5% by mol of iodide (average grain size: 0.6 μ, which contained 100 g of silver halide and 70 g of gelatin per kg of the emulsion) was prepared. To 1 kg of this emulsion, 20 cc of an aqueous solution of 5% by weight of 5-methyl-7-hydroxy-2,3,4-triazaindolizine and 570 g of the yellow coupler Emulsion (5) having the following composition and 30 g of Emulsion (6) having the following composition were added. Further, 500 cc of an aqueous solution of 2% by weight of 2-hydroxy-4,6-dichlorotriazine sodium salt was added as a gelatin hardening agent to produce an emulsion for the unit emulsion layer having a low sensitivity. This emulsion is designated (3A).

| Emulsion (5): | | |
|---|---|---|
| (1) | Gelatin (10% by wt. aq. soln.) | 1,000 g |
| (2) | Sodium p-Dodecylbenzene Sulfonate | 5 g |
| | Tricresylphosphate | 80 cc |
| | Yellow Coupler (Y - 1) | 100 g |
| | Ethyl Acetate | 120 cc |

Yellow Coupler (Y-1)

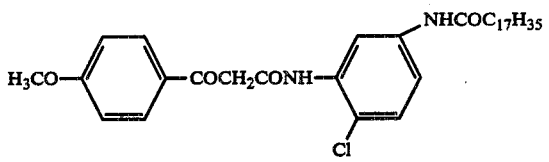

| Emulsion (6): | | |
|---|---|---|
| (1) | Gelatin (10 % by wt. aq. soln.) | 1,000 g |
| (2) | Sodium p-Dodecylbenzene Sulfonate | 5 g |
| | Tricresyl Phosphate | 80 g |
| | Yellow Coupler (Y - 1) | 10 g |
| | DIR Yellow Coupler (D - 3) | 90 g |
| | Ethyl Acetate | 120 cc |

DIR Yellow Coupler (D - 3):

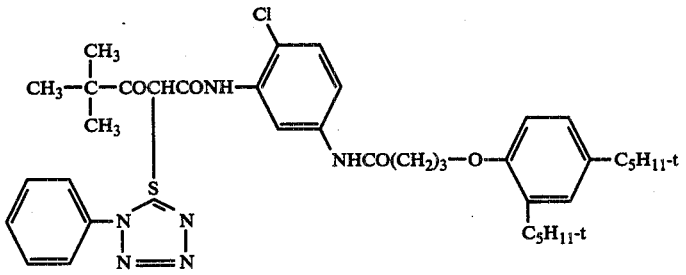

Emulsification was carried out by the same procedures as in the case of Emulsion (1).

3 - b: Preparation of a silver halide emulsion for the unit emulsion layer having an intermediate sensitivity:

The procedures in 3 - a were repeated with the following modifications.

| | |
|---|---|
| Average Grain Size of Silver Halide | 0.9 μ |
| Amount of Emulsion Added | Emulsion (5): 380 g<br>Emulsion (6): 20 g |

This emulsion is designated (3B).

3 - c: Preparation of a silver halide emulsion for the unit emulsion layer having a high sensitivity:

The procedures of 3 - a were repeated with the following modifications.

| | |
|---|---|
| Average Grain Size of Silver Halide | 1.1 μ (but the amount of grains having a grain size of more than 1.0 μ was 50% by weight of the total grains and 8.9% of the total grains had a grain size of 2.0 μ or more) |
| Amount of Emulsion Added | Emulsion (7): 200 g |

This emulsion is designated (3C).

| Emulsion (7): | | |
|---|---|---|
| (1) | Gelatin (10 % by wt. aq. soln.) | 1,000 g |
| (2) | Sodium p-Dodecylbenzene Sulfonate | 5 g |
| | Tricresyl Phosphate | 80 cc |
| | Yellow Coupler (Y - 2) | 100 g |
| | Ethyl Acetate | 120 cc |

Yellow Coupler (Y - 2):

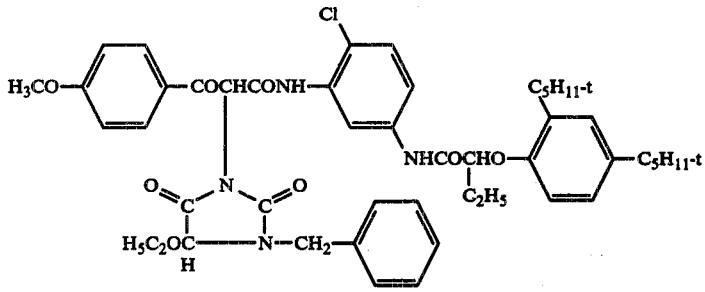

Emulsification was carried out using the same procedures as in the case of Emulsion (1).

To a cellulose triacetate support, emulsion layers were coated so as to have the silver content as shown in Table 5 below. Coating was carried out in the order shown in Table 5 below.

Table 5

| Layer | Film A Emulsion | Silver Content ($mg/dm^2$) |
|---|---|---|
| a | (1A) | 10 |
| b | (1B) | 8 |
| c | (1C) | 12 |
| d | Gelatin intermediate layer (dry thickness: 1.0 μ) | — |
| e | (2A) | 12 |
| f | (2B) | 10 |
| g | (2C) | 12 |
| h | Yellow filter layer composed of yellow colloidal silver (dry thickness: 1.2 μ) | — |
| i | (3A) | 8 |
| j | (3B) | 8 |
| k | (3C) | 6 |
| l | Gelatin protective layer (dry thickness: 1.2 μ) | — |

In a similar manner, other anti-static agents were substituted for Compound (1), some of which are in the scope of the present invention while others are conventionally known anti-static agents. The anti-static properties of the back surface of the sample films were evaluated using the methods described in Example 1. The sample compositions and the evaluation results obtained are shown in Table 6 below.

Table 6

| Sample No. | Anti-static Agent | Surface Resistance (ohms, 30% R.H.) | Static Mark Generation |
|---|---|---|---|
| 20 | Compound (1) | $6.3 \times 10^9$ | A |
| 21 | " (2) | $3.5 \times 10^{10}$ | A |
| 22 | " (5) | $4.2 \times 10^9$ | A |
| 23 | " (6) | $8.6 \times 10^{10}$ | A |
| 24 | " (8) | $8.1 \times 10^{10}$ | A |
| 25 | " (A) | $8.3 \times 10^{11}$ | B - C |
| 26 | " (B) | $1.3 \times 10^{13}$ | C - D |
| 27 | None | $10^{15}$ or more | E |

According to the results in Table 6 above, static electrification can be suppressed by using the compounds of the general formula (I) employed in the present invention.

EXAMPLE 4

8 g of each of Compounds (1), (2), (5), (8) and (9) as used in the present invention and Compounds (A) and (B) as conventionally known compounds was dissolved in 10 ml water, and further diluted with 650 ml of methanol and 350 ml of acetone. This solution was coated on a cellulose triacetate film at a rate of 50 $mg/m^2$ and the film was dried.

Over this coating, a dispersion comprising cellulose diacetate dissolved in 300 ml of acetone and 600 ml of methanol and a finely-divided silicon dioxide manufactured by Aerosil Co. with a particle diameter of from 0.1 to 1 micron was coated in a coating rate of cellulose diacetate of 100 $mg/m^2$ and silicon dioxide of 10 $mg/m^2$. On the opposite side of the thus coated film support was coated an indirect X-ray emulsion comprising 9% by weight of gelatin and 9% by weight of silver iodobromide containing 5 mol % iodide.

Using these procedures, the samples shown in Table 7 below were prepared, Sample Nos. 28 to 32 are in accordance with this invention while Sample Nos. 33 and 34 each contain the compound for comparison and Sample No. 34 is a control. The surface resistance was measured as described in Example 1 and in order to evaluate the degree of generation of static marks each sample was processed at 20° C. for 5 minutes with a developer having the formulation described in Example 1. The measured values of the surface resistance of the back surface and the evaluations of the generation of static marks are shown in Table 7 below.

Table 7

| Sample No. | Anti-static Agent | Surface Resistance (ohms) | Static Mark Generation |
|---|---|---|---|
| 28 | Compound (1) | $8.7 \times 10^9$ | A |
| 29 | " (2) | $1.2 \times 10^{10}$ | A |
| 30 | " (5) | $2.6 \times 10^9$ | A |
| 31 | " (8) | $9.0 \times 10^9$ | A |
| 32 | " (9) | $2.0 \times 10^{10}$ | A |
| 33 | " (A) | $6.5 \times 10^{12}$ | B |
| 34 | " (B) | $4.0 \times 10^{13}$ | B -C |
| 35 | None | $10^{15}$ or more | E |

By employing a compound of the general formula (I) as used in the present invention, the surface resistivity was markedly reduced, and generation of static marks was substantially prevented. On the contrary, it is evident that a considerable tendency toward generation of static marks exists for the films which contained conventionally known anti-static agents or which did not contain an anti-static agent.

EXAMPLE 5

A subbing coating of the following composition was coated on a 130 micron cellulose triacetate film and then dried.

| | % by weight |
|---|---|
| Gelatin | 1.35 |
| Acetic Acid | 0.56 |
| Water | 2.00 |
| Methyl Cellosolve | 5.00 |
| Methanol | 15.00 |
| Acetone | 76.09 |

On this subbing coating was overcoated an anti-static coating using a coating solution of the following composition.

| | |
|---|---|
| Anti-static Agent (as in Table 8) | 8 g |
| Water | 10 ml |
| Methanol | 600 ml |
| Acetone | 400 ml |

On the anti-static layer were further provided three layers simultaneously by extrusion coating at a coating speed of 30 m/min. The three layers were a red sensitive photographic silver halide emulsion layer, an intermediate layer and a green sensitive photographic silver halide emulsion layer, all being disclosed as Sample 2 in Example 1 of U.S. Patent Application Ser. No. 592,293 filed July 1, 1975 (corresponding to British Pat. No. 1,490,644). The red sensitive layer was contiguous to the anti-static coating while the green sensitive layer was placed outermost.

In this example, the degree of coating non-uniformity based on the charging phenomenon during coating was checked by closely examining the emulsion layers by transmitted light with the naked eye. The results obtained are shown in Table 8 below.

Table 8

| Sample No. | Anti-static Agent | Coating Uniformity |
|---|---|---|
| 11 | Compound (1) | Substantially perfect |

Table 8-continued

| Sample No. | Anti-static Agent | | Coating Uniformity |
|---|---|---|---|
| 12 | " | (5) | Substantially perfect |
| 13 | " | (A) | Non-uniformity present |
| 14 | " | (B) | Non-uniformity present |
| 15 | Blank | | Non-uniformity is noticeable |

As is evident from the results in Table 8, coating non-uniformity was not observed in those sample films which had an anti-static coating in accordance with the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having improved anti-static properties, comprising a support having thereon at least one silver halide emulsion layer and wherein at least one compound having a molecular weight of about 1,000 to about 50,000 and a recurring unit represented by the following general formula (1)

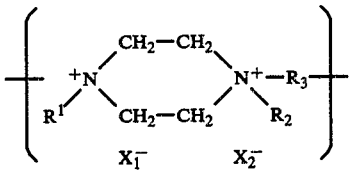

(I)

wherein $R_1$ and $R_2$, which may be the same or different, each represents an alkyl group, a cycloalkyl group, an aralkyl group, an aryl group or an alkenyl group, and $R_1$ and $R_2$ can combine to form an alkylene group; $R_3$ represents an alkylene group or an aralkylene group, each having up to ten carbon atoms; and $X_1^-$ and $X_2^-$ each represents an anion; is present in an outermost layer of said photographic material, in a layer contiguous to a subbing layer for a silver halide emulsion layer in said photographic material, and/or in a layer contiguous to the outermost layer provided on the opposite side of the support to that on which said silver halide emulsion layer is present in said photographic material.

2. The silver halide photographic material of claim 1, wherein $R_1$ and $R_2$ each represents an alkyl group having from 1 to 10 total carbon atoms, which may be unsubstituted or substituted with one or more of a cycloalkyl group, a hydroxy group, a cyano group, an amido group, a carboxyl group, an alkoxycarbonyl group and a carbamoyl group as substitutents; a benzyl group; a phenethyl group; allyl group or a cyclohexyl group; and $R_1$ and $R_2$ when combined together form an ethylene group; $R_3$ represents an o-xylylene group, a m-xylylene group, a p-xylylene group, an ethylene group, a tetramethylene group, a hexamethylene group, an octamethylene group, a propylene group or ethylethylene group; $X_1^-$ and $X_2^-$ each represents a chlorine ion, a bromine ion, an iodine ion, $R_4O\text{-}SO_2\text{-}O^{\ominus}$, $R_4\text{-}SO_2\text{-}O^{\ominus}$ or $(HO)_2PO\text{-}O^{\ominus}$; and $R_4$ represents a methyl group, an ethyl group, a phenyl group or a phenyl group substituted with one or more methyl groups.

3. The silver halide photographic material of claim 1, wherein the compound having therein the recurring unit represented by general formula (I) is a compound having therein a recurring unit of the formula

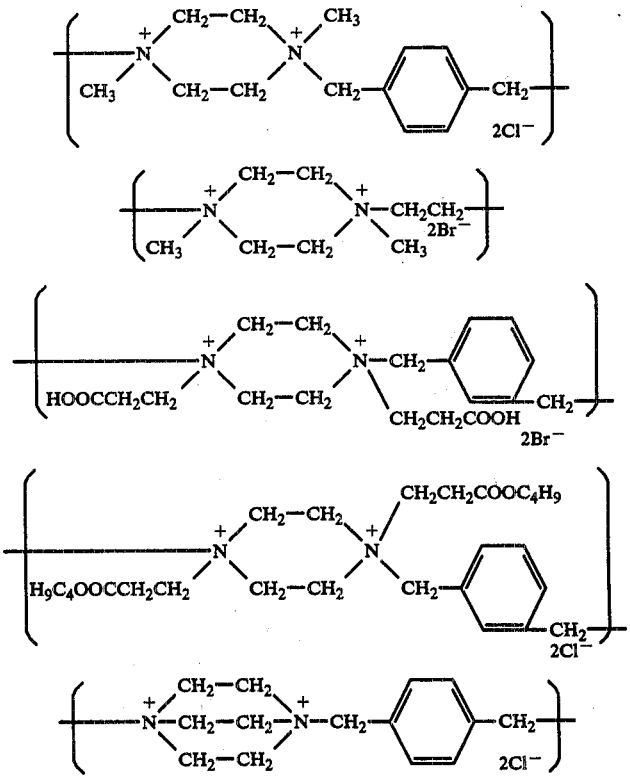

-continued

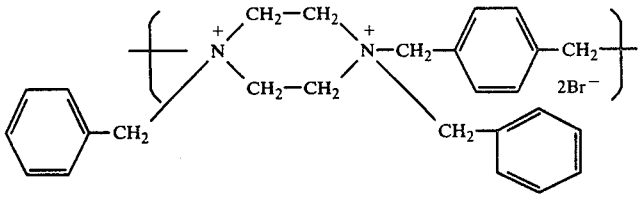

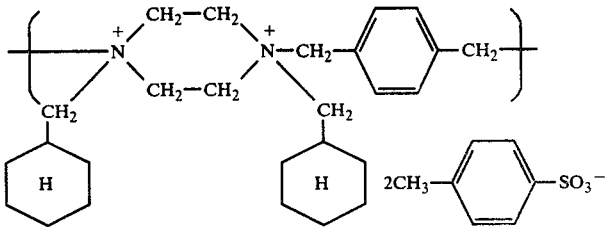

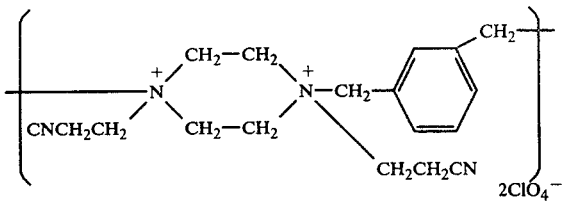

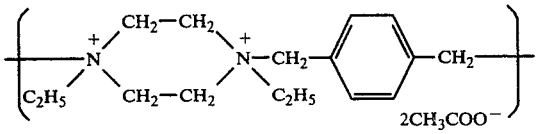

or

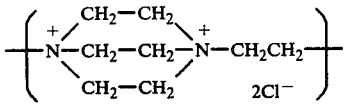

4. The silver halide photographic material of claim 1, wherein the outermost layer containing the compound having therein the recurring unit represented by the general formula (I) is a back coating of said photographic material.

5. The silver halide photographic material of claim 1, wherein the compound having therein the recurring unit represented by general formula (I) is present in an amount of about 0.01 to about 1.0 g/m$^2$.

6. The silver halide photographic material of claim 1, wherein said outermost layer additionally contains a matting agent.

7. The silver halide photographic material of claim 1, wherein said outermost layer additionally contains a fluorine-containing surface active agent.

8. The silver halide photographic material of claim 1, wherein said material includes (a) a layer with a compound having therein the recurring unit represented by general formula (I) on the opposite surface of said support to that on which said silver halide emulsion layer is coated and (b) a layer of cellulose diacetate containing colloidal silica on said layer (a).

9. A method of preventing the generation of static charges in a silver halide photographic material comprising a support having thereon at least one silver halide emulsion layer, which comprises incorporating in an outermost layer of said photographic material, in a layer contiguous to a subbing layer for a silver halide emulsion layer in said photographic material and/or in a layer contiguous to the outermost layer provided on the opposite side of the support to that on which the silver halide emulsion layer is present in said photographic material, a compound having a molecular weight of about 1,000 to about 50,000 and a recurring unit represented by the general formula (I)

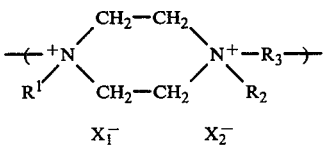

(I)

wherein $R_1$ and $R_2$, which may be the same or different, each represents an alkyl group, a cycloalkyl group, an aralkyl group, an aryl group or an alkenyl group, and $R_1$ and $R_2$ can combine to form an alkylene group; $R_3$ represents an alkylene group or an aralkylene group, each having up to ten carbon atoms; and $X_1^-$ and $X_2^-$ each represents an anion.

10. The method of claim 9, wherein said method comprises incorporating in said outermost layer of said photographic material a matting agent together with said compound represented by the general formula (I).

* * * * *